US005839303A

United States Patent [19]

Umberg et al.

[11] Patent Number: 5,839,303

[45] Date of Patent: Nov. 24, 1998

[54] SECURING AND LOCKING DEVICE

[75] Inventors: John Umberg, Diamond Bar; Greg Umberg, Chino Hills; Tanfirio J. Palmese, Aliso Viejo, all of Calif.

[73] Assignee: Business Machine Security, Inc., Brea, Calif.

[21] Appl. No.: 862,553

[22] Filed: May 23, 1997

[51] Int. Cl.[6] ..... E05B 69/00

[52] U.S. Cl. ..... 70/58; 248/553; 70/232

[58] Field of Search ..... 70/14, 18, 19, 70/57, 58, 158, 163, 164; 248/551–553

[56] References Cited

U.S. PATENT DOCUMENTS

| | | | |
|---|---|---|---|
| 3,766,759 | 10/1973 | Artner | 248/553 X |
| 4,066,231 | 1/1978 | Bahner et al. | 248/552 |
| 4,656,848 | 4/1987 | Rose | 70/232 X |
| 4,691,891 | 9/1987 | Dionne | 248/551 |
| 4,979,382 | 12/1990 | Perry | 248/553 X |
| 5,007,256 | 4/1991 | Lowe | 248/553 X |
| 5,050,836 | 9/1991 | Makous | 248/553 |
| 5,082,233 | 1/1992 | Ayers et al. | 248/553 |
| 5,116,015 | 5/1992 | Gassaway | 248/553 |
| 5,388,434 | 2/1995 | Kalis | 248/553 X |
| 5,456,443 | 10/1995 | Taaffe | 248/551 |
| 5,487,523 | 1/1996 | Ingram et al. | 248/551 |
| 5,579,657 | 12/1996 | Makous | 248/551 X |
| 5,660,451 | 8/1997 | Glynn | 248/551 X |
| 5,667,187 | 9/1997 | Doman et al. | 248/551 |
| 5,692,722 | 12/1997 | Lundagårds | 248/533 |

*Primary Examiner*—Suzanne Dino Barrett
*Attorney, Agent, or Firm*—Knobbe, Martens, Olson & Bear LLP

[57] ABSTRACT

A device and method are provided for securing and selectively locking a portable item to a supporting surface. A generally flat attachment plate is connected to a generally flat base plate containing a lock barrel and a lock cylinder. The attachment plate fastens to a device being secured. A securing stud fastens to the underside of the supporting surface such that the shaft of the securing stud protrudes through a hole in the support surface and base plate to extend into threaded engagement with the lock cylinder barrel. The securing stud has a thin flat head which when adhesively attached to the supporting surface prevents the securing stud from being rotated or removed.

22 Claims, 5 Drawing Sheets

SECURING AND LOCKING DEVICE

FIELD OF THE INVENTION

The present invention relates to a securing device and method for securing an item such as a television to a supporting structure, such as a cart.

BACKGROUND OF THE INVENTION

It is often necessary to secure an item to the surface it is resting upon to prevent the item from being stolen or from falling. Although many items are of low value and do not warrant precautionary measures, other items are valuable, fragile or commonly stolen. For example, televisions or video monitors, may topple if not secured to the surface on which they rest during earthquakes or if carts are used to wheel the items from one location to another. The cart acts as the support surface and is often unstable, especially when traversing unlevel surfaces or negotiating turns. Should an item topple off a cart or shelf, it will likely be damaged or seriously injure an individual hit by the falling item.

In addition, many items are at risk of theft. While a locking cabinet, drawer or closet can contain some valuable items, other items are not easily concealed because of their size. Similarly, some items must be left un-monitored in open areas, often for extended periods of time. For example, computer equipment is left exposed on desks and tables and can not conveniently be moved to a storage cabinet at night or when not monitored.

It is an object of the present invention to secure and lock items of this nature.

Other devices designed to achieve this goal ire often expensive, complicated, require extensive modification and integration with the item and the support surface, or require that the item be permanently fixed to the support surface. Previous securing devices include fabric or nylon cinch straps which are difficult to install, fasten and unfasten, metal boxes or enclosures that are heavy and require excessive room to store the enclosure when not in use, or cables having an internal frame anchoring system that are hard to install and easily cut.

The present invention provides a simple, visually pleasing, easy to manufacture device and method for securing an item to a support surface without extensive modification to either the item or the support surface. It further allows the item to be moved from the support surface through the use of a simple lock and key mechanism which is operable with one hand.

SUMMARY OF THE INVENTION

The present invention provides a device and method for securing and selectively locking an item to a supporting surface. In particular, the device comprises a generally flat attachment plate connected to a generally flat base plate preferably in the form of an "L" shaped bracket. A lock barrel attaches to the top side of the base plate. The lock barrel has an inner surface with grooves running vertically to accept lock wavers from a lock barrel. A lock cylinder fits within a hollow center of the lock barrel. The lock cylinder has a hollow base section with internal threads and a mid-section having one or more wafers that extend from the lock cylinder when the key is removed. When the key is inserted, the lock wafers are flush with the body of the lock cylinder so the cylinder can rotate within the barrel. When the key is removed the lock wafers are resiliently urged outward from the cylinder to engage a groove in the barrel and restrain rotation of the cylinder.

Finally, a finish covers the entire surface of the securing device to create an aesthetically pleasing appearance.

The securing device attaches to the item to be secured with two sided adhesive tape with a neoprene or similar material base interposed between, and adhered to the attachment plate and the item. Likewise, the shaft side of a securing stud head is covered with two sided adhesive tape. Immediately prior to installation, a protective sheet is removed from the outer surface of the adhesive tape thereby exposing the adhesive. The attachment plate is positioned on the attachment surface so that the bottom surface of the base plate contacts the support surface. The attachment plate is then firmly pushed onto the attachment surface to adhesively secure the securing device to the item. A hole in the base plate aligns with a hole in the supporting surface. The securing stud runs through the aligned holes in the support surface and the base plate so that the threaded shaft of the securing stud protrudes into the lock barrel. Once in place, the adhesive tape securely connects the securing device to the item to be secured. Similarly, the adhesive tape permanently attaches the securing stud to the support surface.

A lock cylinder, having threads inside a hollow lower portion rests inside the lock barrel. The lock cylinder connects to the threaded stud shaft by rotationally threading the hollow threaded base of the lock cylinder onto a threaded shaft of a securing stud which protrudes up through the aperture in the supporting surface, through the aperture in the base plate and into the lock barrel. The adhesive securely attaches the securing stud to the underside of the support surface to prevent the securing stud from rotating as one with the lock cylinder or prevent the securing stud from being rotated independent of the lock cylinder. Such rotational tightening secures the base plate to the supporting surface.

In the locked position, assumed by removing the lock key, lock wafers extend into a groove in the inner surface of the lock barrel. This prevents the lock cylinder from being unscrewed from the securing stud and removed. Reinserting the key into the lock cylinder positions the lock wafers flush with the body of the lock cylinder thereby allowing the lock cylinder to rotate and be removed. Once the lock cylinder is removed, the item, with the attachment plate, base plate, and lock barrel attached, can be lifted from the securing stud.

A general object of the present invention is to overcome the limitations and inconveniences of the prior art by providing a simple and quick method to secure an item to a surface.

A more specific object of the present invention is to secure a television to a cart by adhesively attaching the securing device to the video monitor and to further lock the securing device to the support surface.

A further object of the present invention is to provide the ability to attach and lock the securing device using only one hand.

Further objects, features and advantages of the present invention over the prior art will become apparent from the detailed description which follows, when considered with the attached figures.

DETAILED DESCRIPTION OF THE PREFERRED EMBODIMENT

Figure 1:
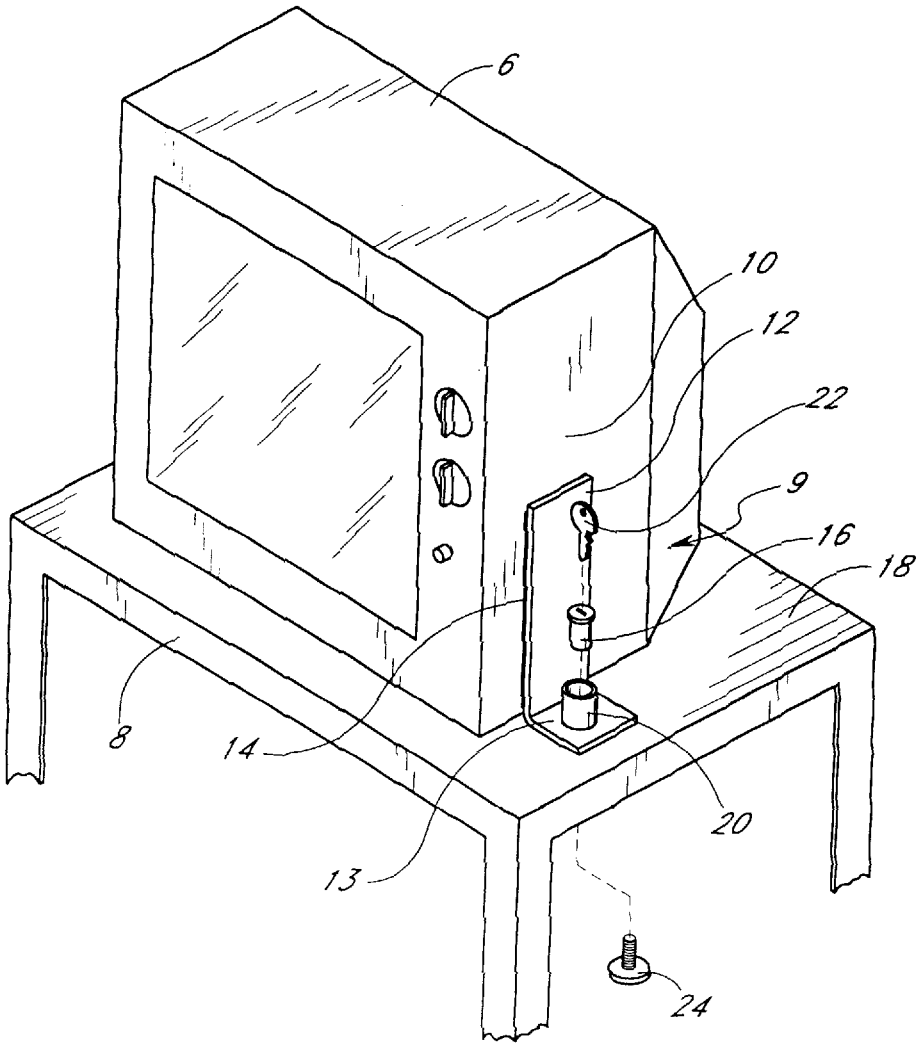
FIG. 1 is a perspective view of the device of the present invention securing a television to a support surface.
Figure 2:
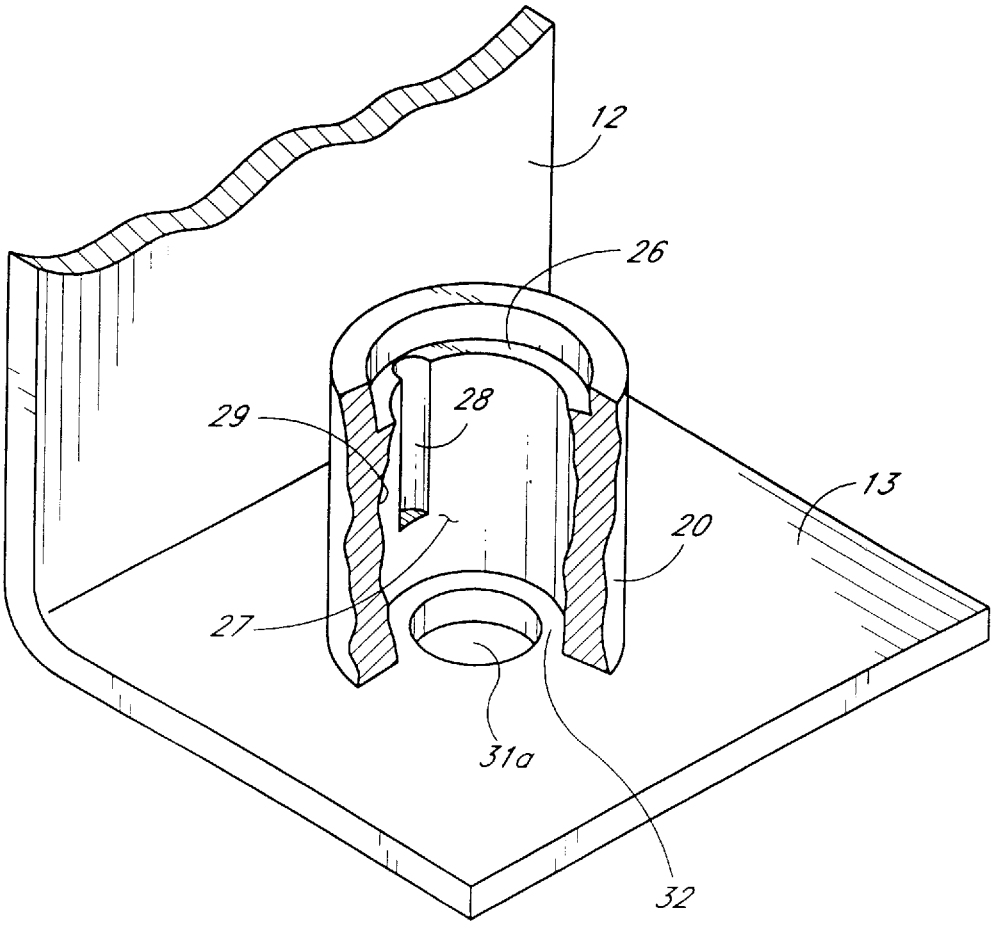
FIG. 2 is a partial, cross-sectional perspective view of the lock barrel of the device of the present invention.
Figure 3:
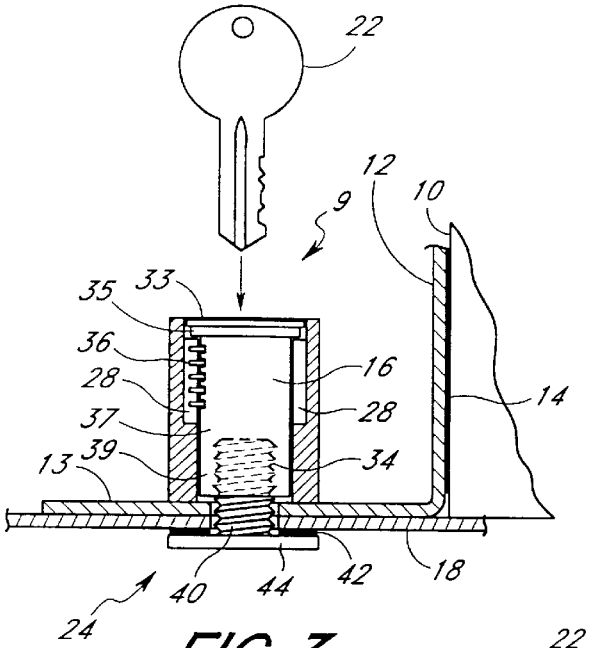
FIG. 3 is a side cross sectional view of the lower portion of a locking device with key removed and corresponding lock wafers extending into a groove in a lock barrel.

FIGS. 1–3 illustrate a securing device 9 of the present invention in conjunction with an item 6, such as a television, and a cart 8. Often the item 6 is portable in that it may be carried by one to three persons although one person alone is usually sufficient. The securing device 9 comprises an attachment plate 12, generally perpendicular to a base plate 13 to form an "L" shaped configuration, although other configurations could be used depending on the shape of the support surface 18 and the restrained item 6. A lock barrel 20 with an associated lock cylinder 16 mounts on the base plate 13, and is preferably welded with the longitudinal axis of the barrel 20 generally perpendicular to the base plate 13. In conjunction with the lock cylinder 16 and a securing stud 24, the barrel 20 locks the securing device 9 to a supporting surface 18.

As seen in FIGS. 2–6, a lock barrel 20 with an associated lock cylinder 16 is mounted to the base plate 13. The lock barrel 20 is preferably welded to the base plate 13, however other methods of attachment could be used as known to those skilled in the art. The lock barrel 20 has a hollow cylindrical cavity or center 27 with an inner surface 29. The hollow center 27 and the lock barrel 20 share a common center axis aligned perpendicular to the plane of the base plate 13. The hollow cylindrical center 27 has inner dimensions selected to accommodate a lock cylinder 16.

Figure 7:
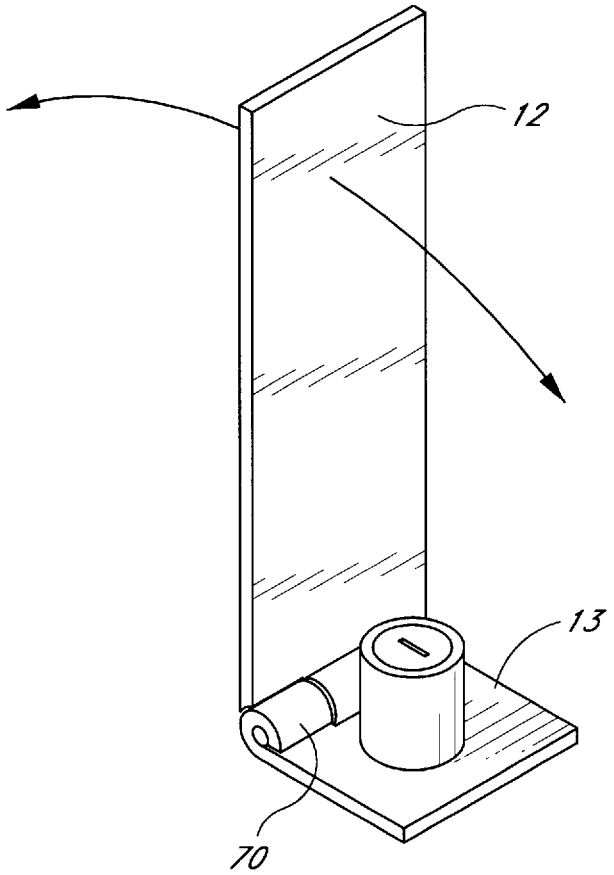
FIG. 7 is a perspective view of the locking device configured with a hinge joint.

The distal end of the cylindrical center 27 has a recessed ledge 26 encircling the cavity or center 27. The ledge 26 engages a lock cylinder shoulder 35 to position lock face 33 with the top or distal end of the lock barrel 20 and provides support when the lock cylinder 16 is rotationally secured to a securing stud 24. The attachment plate 12 is generally found at a right angle with the base plate 13, typically by bending a strip of metal to the desired shape. As shown in FIG. 7, the attachment plate 12 may connect to the base plate 13 with a hinge joint 70 thereby allowing a user to selectively mate the attachment plate at various angles relative to the base plate. Alternatively, the plates 12, 13 could be bent or otherwise joined at any desired angle.

Two opposing concave grooves 28, located or the inner surface 29 of the lock barrel 20, extend parallel to the cylindrical lock barrel center axis and extend into the barrel 20. Each groove 28 begins at the top or distal end of the lock barrel 20 and extends toward the base 13 to a distance midway down the lock barrel. The groove length, groove depth, and groove shape is sufficient to accommodate one or more lock wafers 36 when the lock cylinder 16 is locked in the lock barrel 20.

The base plate 13 has a base plate aperture 31 centered at the bottom cavity or center 27, and coaxial with the longitudinal axis of the barrel 20 which extends through base plate 13 and support surface 18. When assembled, the stud shaft 40 fits through the support surface 18 through the base plate aperture 31 and into the lock barrel 20.

Referring to FIGS. 3–6, the lock cylinder 16 fits inside the lock barrel 20. The lock cylinder 16 has a top head 33, a body 37, and a base 39. The lock cylinder 16 contains multiple lock wafers 36 that have two opposing positions, either flush with or protruding from the lock cylinder body 37. The base 39 of lock cylinder 16 also contains a hollow inner bore having inner threads 34. The lock cylinder 16 has a corresponding key 22, which upon insertion into the lock cylinder, preferably positions the lock wafers 36 flush with the lock cylinder body 37. As is know by those with skill in the art, duplicate keys 22 may be cut to operate each lock cylinder 16 or multiple lock cylinders may be configured to work with a single key shape.

Figure 6:
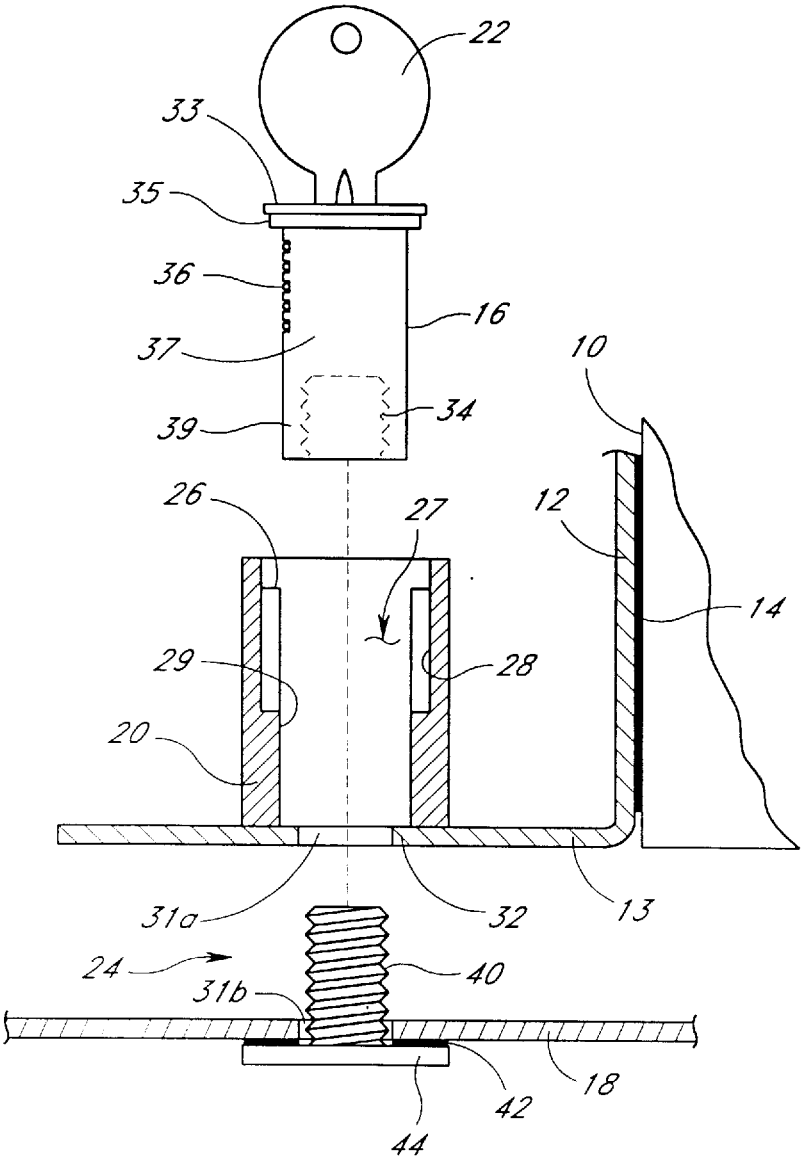
FIG. 6 is a side cross sectional view of the lower portion of a locking device with key and corresponding threaded securing stud.

As seen in FIG. 6, the lock head 33 has a recessed support shoulder 35 adjoining a further recessed diameter lock cylinder body 37.

A securing stud 24 attaches to the threaded section of the lock cylinder base 39. The aperture 31 is configured to allow passage of a fastener, such as stud 24. The securing stud 24 comprises a threaded securing stud shaft 40, a flat cylindrical head base 44, and adhesive stud attachment means 42 abutting the head base. The stud 24 can comprise a pem stud having a threaded shank 40 and smaller diameter flat head that is swaged into a flat annular slug to form a larger diameter, thin, flat head 44.

Preferably, the stud attachment means 42 comprises two sided adhesive tape with a neoprene base. Alternatively, a material similar to neoprene is acceptable, including but not limited to foam. The adhesive tape may be made with a number of different substrates, including but not limited to foam, neoprene or other similar material. The stud attachment means 42 advantageously keeps the stud 24 from turning while simultaneously holding the stud 24 in position, thereby preventing it from falling out of hole 31. This frees one hand from holding the stud 24 which in turn makes it much easier to place the base plate 13 over the stud shaft 40 and connect the lock 16.

Preferably, the adhesive tape has thickness approximately less then 0.0625 inches; however adhesive tape having thickness from 0.0625 to 0.125 inches is acceptable although the bond formed therebetween is not as strong. Adhesive tape with the indicated thickness allows for some resilient movement without breaking the bond therebetween. Similarly for means 42, double sided adhesive tape having greater thickness provides greater conformity to attachment surfaces 18 with porous or textured surfaces. But, such increased conformity decreases the adhesive strength. Alternatively, thinner adhesive tape may be used for greater adhesion to smooth surfaces, however, adhesion to porus or textured surfaces will decrease.

An aperture 31*a* though the base plate 13 aligns with an aperture 31*b* drilled in the supporting surface 18. Aperture 31*a* is smaller than the cavity 27 so the base plate 13 forms a ring 32 around aperture 31*a*. The stud attachment means 42 is interposed between the head 44 and support surface 18 with the adhesive exposed.

The securing stud 24 is then inserted through the support surface aperture 31*b* and the base plate aperture 31*a* to protrude into the lock barrel 20. One side of the two sided adhesive tape is adhesively secured to the shaft side of the securing stud 24, while the other side, with protective covering removed, is adhesively secured to the supporting surface 18. The securing stud attachment means 42 connects head 44 to support 18 which prevents the securing stud 24 from rotating with the lock cylinder 16 or falling out when not rotationally connected to the lock cylinder 16. The head 44 has a flat smooth outer portion thereby preventing engagement with a driving or turning device or tool. Similarly, the head 44 is sufficiently thin to make turning the head with pliers difficult.

Figure 4:
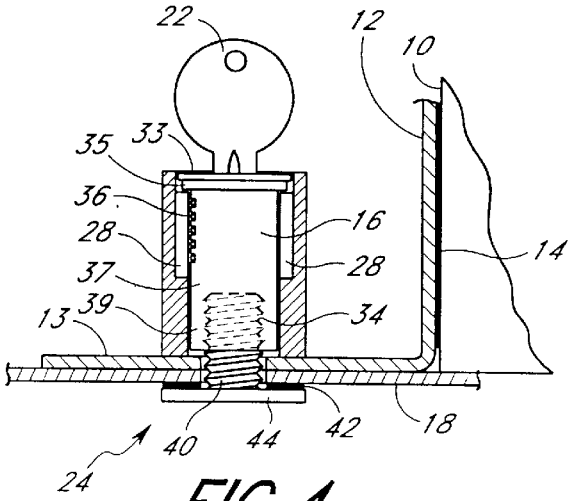
FIG. 4 a side cross sectional view of the lower portion of a locking device with a corresponding key inserted and lock wafers flush with lock cylinder surface.
Figure 5:
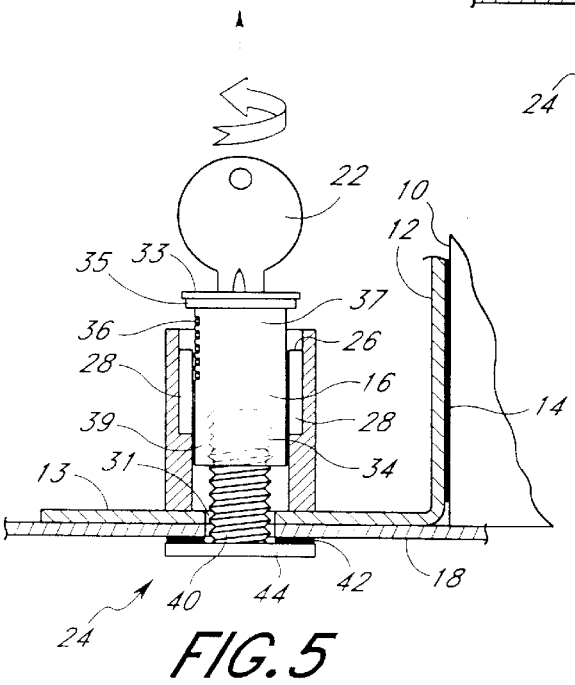
FIG. 5 is a side cross sectional view of the lower portion of a locking device with lock cylinder being rotationally removed from a securing stud.

As seen in FIGS. 3–5, the lock cylinder 16, with the lock key 22 inserted and the lock wafers 36 flush with the lock cylinder body 37, fits into the lock barrel 20. The lock cylinder 16 rotates to securely couple the threads of the stud shaft 40 with the threaded hollow bore 34 in the lock cylinder base 39. The lock cylinder 16 rotates until secured between both the lock barrel shoulder 26 and the base plate support ring 32 in the base plate 13.

The lock cylinder 16 is rotationally aligned so that the lock wafers 16 align with the lock barrel grooves 28. Removing the lock key 22 extends the lock wafers 16 into the lock barrel groove 28 to prevent further rotation of the lock cylinder 16. Thus, the securing device, with item 6 securely attached, is locked.

Alternatively, the base plate 13 could connect to the support surface first and then the item 6 positioned to adhesively attach to thc attachment plate 12.

To remove the secured item 6 from the support surface 18, the securing device 9 is unlocked. The lock key 22 is inserted into the lock cylinder 16 thereby recessing the lock wafers 36 flush with the lock cylinder body 37. The lock cylinder 16 then rotates until free from the lock barrel 20. The item 6 is then removable from the supporting surface 18 because the base plate 13 is removable from the securing stud 40.

An aesthetically pleasing coating preferably covers all exterior surfaces of the attachment plate 12, base plate 13, and lock barrel 20. The aesthetically pleasing coating attaches to the underlying material. Preferably, the aesthetically pleasing coating comprises a black paint powder coating.

The lock head 33, working in conjunction with the lock barrel 20, is of sufficient diameter to prevent access to the lock wafers 36 thereby preventing lock picking tools from being inserted between the lock wafers and the inner surface 29 of the lock barrel.

The attachment plate 12 attaches to an attachment surface 10 of an item 6 that is to be secured. The size of the attachment plate 12 is sufficient to provide adequate surface area for the adhesive attachment means to securely bond with and support the item 6. The size and contact area of the attachment plate 12 is selected depending on the item 6 and forces resisted. For a heavy item 6, such as a television, enough contact area is required to prevent it from falling in an earthquake or if a cart 8 on which it rested fell over. To insure proper securement, multiple devices 9 could secure an item 6. For example, a device 9 securing each side of a television would prevent the television from twisting loose from the device 9. Likewise, the shape of attachment plate 12 and base plate 14 may vary to conform to the contour of an attachment surface 10.

Preferably, the attachment means 14 comprises two sided adhesive tape with a neoprene back. One side of the two sided adhesive tape is adhesively secured to the attachment plate 12 and the other side of the tape adheres to the attachment surface 10. Other methods of attaching the attachment plate 12 to the item 6 exist and including gluing, screwing, riveting, latching, or locking.

During installation, an installer removes the protective covering from the adhesive tape to expose the adhesive and then firmly presses the attachment plate 12 to the attachment surface 10. The thickness of the adhesive tape is selected to conform to the roughness of the attachment surface 10 of the item 6 restrained. Double sided adhesive tape with greater thickness provides greater conformity to attachment surfaces with porous or textured surfaces. But, the increase in conformity between the attachment plate 12 and the attachment surface 10 results in a decrease in adhesive because the adhesive tape can more easily tear between the adhesive layers. Thinner adhesive tape may provide greater adhesion to smooth surfaces, but, with thinner tape the conformity to porus or textured surfaces decreases.

Alternatively, in some situations the lock 16 and stud 24 may removably mount to the item 6 while the attachment plate adhesively attaches to the support surface 18.

It will be understood that the above described arrangements of apparatus and the method therefrom are merely illustrative of application of the principles of this invention and many other embodiments and modifications may be made without departing from the spirit and scope of the invention as defined in the claims.

What is claimed is:

1. A device for securing a portable item to a structure having first and second opposing surfaces and a hole therethrough, comprising:

an attachment plate having adhesive attachment means for attaching the attachment plate to said item;

a base plate connected to said attachment plate; and, locking means on the base plate for locking the base plate to a first surface of said structure by a fastener engaging the second, opposing surface of said structure, the locking means comprising a lock barrel and lock cylinder on a first surface of the support structure and engaging a securing stud shaft section of a securing stud, the stud having a section that is adapted to be adhesively secured to the second, opposing surface of the support structure to restrain movement of the stud during the engagement with the remainder of the locking means.

2. The device of claim 1, wherein the adhesive attachment means comprises two sided adhesive tape less than about 0.0625 inch thick.

3. The device of claim 1, wherein the adhesive attachment means comprises two sided adhesive tape less than about 0.125 inch thick.

4. The device of claim 1, wherein the attachment plate is connected to the base plate at an angle of about 90 degrees.

5. The device of claim 1, wherein the attachment plate is connected to the base plate at an angle other than about 90 degrees.

6. The device of claim 1, wherein said lock barrel has an inner surface having one or more grooves, said lock barrel sized to accept said lock cylinder; and, said lock cylinder fitting inside said lock barrel and having one or more lock wafers which extend into said one or more grooves when a lock key corresponding to said lock cylinder is removed from said lock cylinder.

7. The device of claim 6, wherein said lock cylinder has a hollow threaded bottom section said shaft section of said securing stud having threads that connect to said hollow threaded bottom section of said lock cylinder.

8. A device for fastening a portable item to a support surface of a piece of furniture, comprising:

an attachment plate having an adhesive adhesively secured to one portion of the attachment plate, a base plate connected to the attachment plate;

a lock barrel connected to the base plate, the lock barrel having a wall defining a cavity with a longitudinal axis;

and at least one groove in the lock barrel wall;

a lock cylinder removably insertable into the lock barrel, the lock cylinder having at least one lock wafer, configured and located to removably extend into the at least one groove; and a securing stud extending through the base plate through a hole in the support surface of the furniture and into the lock barrel to releasably fasten to the lock cylinder, said securing stud having a surface adapted to fasten to a surface of said furniture that is opposite said support surface to restrain rotation of said securing stud about a longitudinal axis of said securing stud, said stud being accessible from a surface of said furniture opposite a surface on which said lock cylinder is located when the cylinder is installed.

9. The device of claim 8, wherein said securing stud is adhesively fastened to a support surface using two sided adhesive tape with a neoprene base.

10. The device of claim 8, wherein said adhesive comprises two sided adhesive tape that is less than about 0.125 inches thick.

11. The device of claim 8, wherein said adhesive comprises two sided adhesive tape that is less than about 0.0625 inches thick.

12. The device of claim 8, wherein said adhesive comprises two sided adhesive tape comprises two sided adhesive tape with a neoprene base.

13. The device of claim 8 wherein the attachment plate is connected to the base plate at an angle of about 90 degrees.

14. The device of claim 8 wherein the attachment plate is connected to the base plate at an angle other than about 90 degrees.

15. The device of claim 8, wherein said lock cylinder has a hollow threaded bottom section; and said securing stud has a flat head section and a shaft section, said shaft section having threads that connect to said hollow threaded bottom section of said lock cylinder.

16. A method of securing an item to a support surface of a piece of furniture using a securing device comprising the steps of:

securing a first portion of a plate of a securing device to the item to be secured;

aligning apertures in a base plate and a lock barrel of said securing device with an aperture in a support surface of a piece of furniture;

securing a first surface of said base plate to a first side of said support surface that is larger than the item being secured, the support surface having a second, opposing side;

placing a securing stud through said aperture in said support surface from said second side of said support surface, though said aperture in said base plate and into said aperture in said lock barrel;

securing said stud to said second side of said support surface to restrict movement and rotation of said stud; and attaching a lock cylinder in said lock barrel to said securing stud.

17. The method of claim 16, wherein said step of securing said plate of a securing device to the item to be secured uses two sided adhesive with a neoprene base.

18. The method of claim 17, wherein said step of securing said plate of a securing device to the item to be secured uses two sided adhesive having less than about 0.125 inch thickness.

19. The method of claim 17, wherein said step of securing said plate of a securing device to the item to be secured uses two sided adhesive having less then about 0.0625 inch thickness.

20. A method of securing an item to a support surface comprising the steps of:

adhesively attaching an attachment plate of a securing device using two sided adhesive tape to an attachment surface of an item to be secured, wherein said attachment plate is positioned so that a base plate of said securing device contacts a support surface having a first side against which said item rests and a second, opposing side;

positioning a securing stud through said support surface from said second side, through said base plate and into a lock barrel and securing said securing stud to said second side of said support surface with an adhesive;

rotationally securing a lock cylinder to a shaft of said securing stud; and, removing a key corresponding to said lock cylinder to cause at least one wafer to protrude into at least one groove in said lock barrel.

21. The method of claim 20, wherein said step of securing said securing stud to said second side of said support surface uses two sided adhesive tape.

22. The method of claim 20, wherein said method of rotationally securing said lock cylinder to said shaft of said securing stud comprises grasping said key of said lock cylinder and turning said lock cylinder to thread said lock cylinder onto a threaded portion of said shaft.

* * * * *